US005238540A

United States Patent [19]

Skatulla et al.

[11] Patent Number: 5,238,540

[45] Date of Patent: Aug. 24, 1993

[54] METHOD OF OBTAINING A PURE AROMATIC HYDROCARBON FROM A SUMP PRODUCT OF AN EXTRACTIVE DISTILLATION OF A HYDROCARBON MIXTURE

[75] Inventors: Luzian Skatulla, Mülheim; Hans-Christoph Schneider, Hattingen; Hans-Jürgen Vollmer, Essen, all of Fed. Rep. of Germany

[73] Assignee: Krupp Koppers GmbH, Essen, Fed. Rep. of Germany

[21] Appl. No.: 766,442

[22] Filed: Sep. 26, 1991

[30] Foreign Application Priority Data

Nov. 22, 1990 [DE] Fed. Rep. of Germany ..... 4037060

[51] Int. Cl.[5] ..... B01D 3/40; C07C 7/08

[52] U.S. Cl. ..... 203/25; 203/27; 203/58; 203/84; 203/98; 203/DIG. 9; 203/DIG. 19; 208/313; 585/808; 585/862

[58] Field of Search ..... 203/27, 25, 21, DIG. 19, 203/58, 98, 78, 84, 71, 73, DIG. 9; 208/313, 353, 365, 354, 355, 358; 585/808, 860, 862, 865

[56] References Cited

U.S. PATENT DOCUMENTS

| | | | |
|---|---|---|---|
| 3,707,575 | 12/1972 | Muller et al. | 203/58 |
| 4,128,457 | 12/1978 | Barba et al. | 203/DIG. 19 |
| 4,162,198 | 7/1979 | Stockburger et al. | 203/58 |
| 4,274,841 | 6/1981 | Andresen et al. | 203/27 |
| 4,410,400 | 10/1983 | Preusser et al. | 203/27 |
| 4,586,986 | 5/1986 | Preusser et al. | 203/27 |
| 4,664,783 | 5/1987 | Preusser et al. | 585/808 |
| 4,778,567 | 10/1988 | Kakimoto et al. | 203/27 |

*Primary Examiner*—Wilbur Bascomb, Jr.
*Attorney, Agent, or Firm*—Michael J. Striker

[57] ABSTRACT

The method of obtaining a pure aromatic hydrocarbon from a hydrocarbon starting mixture includes extractively distilling the hydrocarbon starting mixture with a selective solvent; feeding the sump product of the extractive distillation through a first and second auxiliary boilers connected in series to form a cooled sump product at a temperature from 105° to 120° C.; delivering the cooled sump product to a separator distillation column at an entry plate in an upper portion of a separator distillation column and operating the separator distillation column to form a reflux in the upper portion; collecting this reflux and heating it with solvent drawn from the sump of the separator distillation column in a third auxiliary boiler; returning the heated reflux to the separator distillation column at another plate under the entry plate to form a liquid phase on the other plate; conducting the liquid phase formed on the other plate through the second auxiliary boiler to form a vapor-liquid mixture by partial vaporization due to heat from the sump product; feeding the vapor-liquid mixture into a lower portion of the separator distillation column to form a vapor in the upper portion of the separator distillation column; wherein the pure aromatic hydrocarbon leaves the top of the separator distillation column.

9 Claims, 1 Drawing Sheet

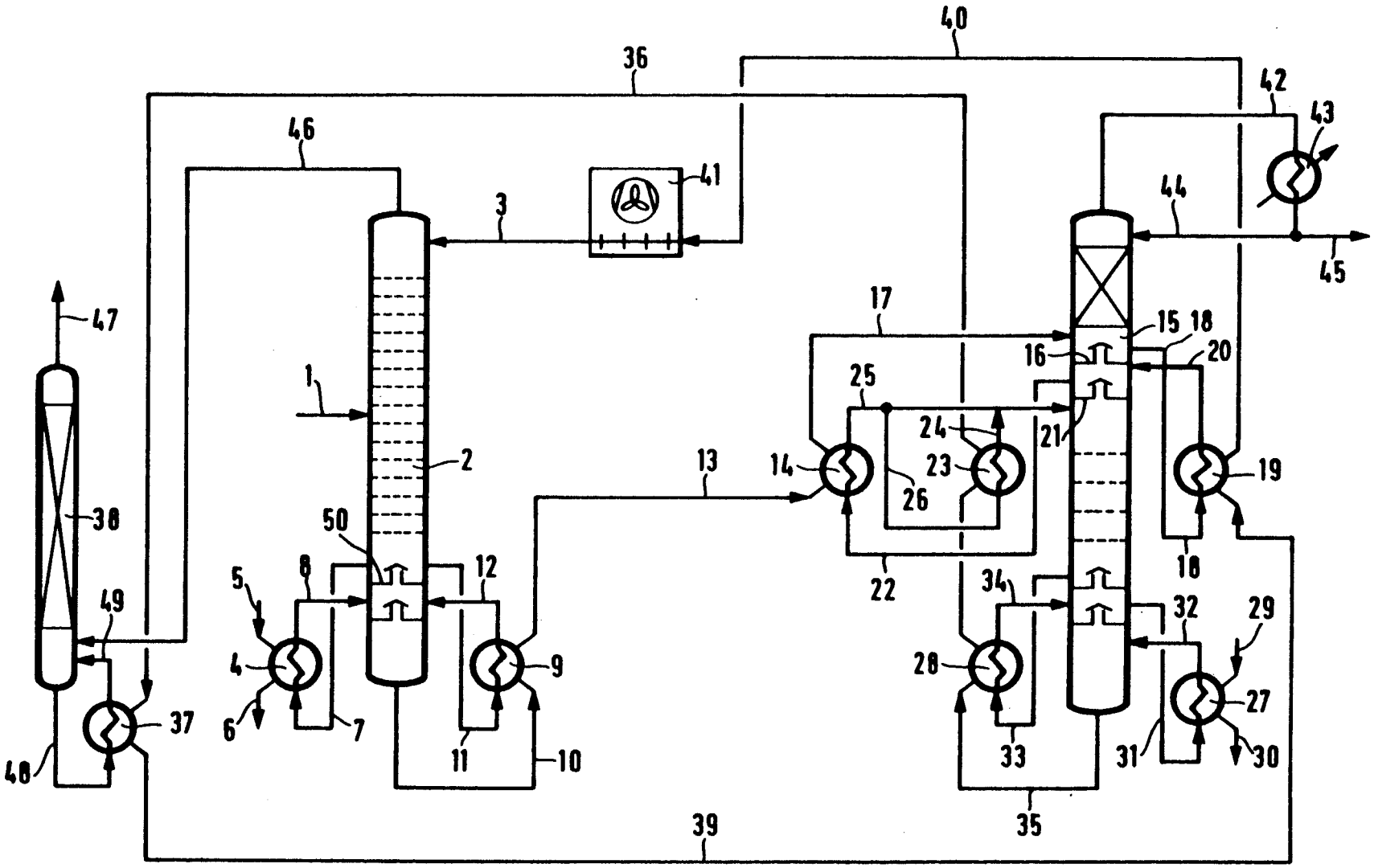
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50

METHOD OF OBTAINING A PURE AROMATIC HYDROCARBON FROM A SUMP PRODUCT OF AN EXTRACTIVE DISTILLATION OF A HYDROCARBON MIXTURE

BACKGROUND OF THE INVENTION

The present invention relates to a method of obtaining a pure aromatic hydrocarbon from a sump product of an extractive distillation of a starting mixture containing hydrocarbons.

A method of obtaining a pure aromatic hydrocarbon from a sump product of an extractive distillation of a starting mixture containing hydrocarbons is known, in which the sump product from the extractive distillation column is fed into a separator distillation column provided with plates, a separator distillation column sump and associated auxiliary boilers. The pure aromatic hydrocarbon is distilled from the top of the separator distillation column. The solvent is drawn from the sump of the separator distillation column and, after indirect heat exchange with other process flows, is fed to the solvent input of the extractive distillation column.

Extractive distillation today is a widely used process for obtaining pure aromatic hydrocarbons from starting mixtures containing hydrocarbon compounds. For performing this kind of extractive distillation process a number of different selective solvents are currently used, including N-substituted morpholines, especially N-formyl morpholine, which have proven to be especially useful. The separating effect of the selective solvent is based on the fact that, because of its presence, the vapor pressure of the individual components of the starting mixture is changed in such a way that the vapor pressure differences between the components, which should be obtained in the extract in the sump product and the components in the top product are increased. Because of that, nonaromatic hydrocarbons leave the extractive distillation column from the top as a lower boiling fraction, while the aromatic hydrocarbons are taken from the extractive distillation column as a higher boiling fraction together with the solvent as a sump product. To separate the pure aromatic hydrocarbon from the selective solvent, the sump product of the extractive distillation column is distilled in a subsequent separator distillation column.

Continuous separation of the aromatic hydrocarbon from the sump product of the extractive distillation column requires a high heat input. The input heat is required principally for separation of the aromatic hydrocarbon from the solvent in a lower portion of the separator distillation column and for distillative separation of the aromatic hydrocarbon from the solvent residue in an upper portion of the separator distillation column. The heat required during operation of the separator distillation column accounts for a considerable portion of the operating expenses of the entire process. An improved method was required for operation of the separator distillation column, which allows processing of the sump product from the extractive distillation column with less heat and thus lower energy costs. Thus an operation of the separator distillation column is desired, which is characterized by an efficient use of heat and a minimum of apparatus expense.

To perform an extractive distillation process for obtaining a pure aromatic hydrocarbon, it is known to use the heat content of the hot solvent flowing from the sump of the separator distillation column. The solvent is cooled prior to its return to the extractive distillation column in an indirect heat exchanger. Thus for example in a report by the applicant (Koppers Bericht (Report) 333 b v. IX. 69) a method for obtaining a pure o-Xylol from a reformate by extractive distillation is described, in which the solvent drawn from the separator distillation column is fed into an indirect heat exchanger for heating of the sump product of the separator distillation column and the extractive distillation column. However the solvent is not cooled enough in the indirect heat exchange with the sump product so that it can be returned directly from the indirect heat exchanger to the extractive distillation column. An additional cooling of the solvent must be performed in an air cooler, so that its heat content is further reduced. An indirect heat exchange between the sump product drawn from the extractive distillation column and other process streams is not provided in this method.

SUMMARY OF THE INVENTION

It is an object of the present invention to provide an improved method of obtaining a pure aromatic hydrocarbon from a sump product of an extractive distillation.

This object, and others which will be made more apparent hereinafter, are attained in a method of obtaining a pure aromatic hydrocarbon from a sump product of an extractive distillation of a hydrocarbon starting mixture containing the aromatic hydrocarbon, the hydrocarbon mixture and a selective solvent being fed to an extractive distillation column. This method comprises feeding the sump product into a separator distillation column provided with plates, an auxiliary boiling device and having a head and a sump, distilling the aromatic hydrocarbon in the separator distillation column, drawing off the solvent from the sump of the separator distillation column and feeding back the solvent, after indirect heat exchange with other process streams produced during the method, to the extractive distillation column.

According to the invention the method further comprises the steps of:

a) prior to feeding the sump product to the separator distillation column, feeding the sump product drawn from the extractive distillation column through a first auxiliary boiler and a second auxiliary boiler connected in series with each other, the sump product being cooled in the auxiliary boilers to a temperature of between 105° and 120° C. by an indirect heat exchange with the other process streams generated in the method to form a cooled sump product;

b) feeding a side-stream from a plate in a lower portion of the extractive distillation column through the first auxiliary boiler used for cooling the sump product and subsequently feeding the side-stream back into the extractive distillation column;

c) delivering the cooled sump product to an entry plate formed as a chimney plate in an upper portion of the separator distillation column;

d) collecting a reflux from the upper portion of the separator distillation column on the entry plate and feeding the reflux so collected into a third auxiliary boiler, heating the reflux in the third auxiliary boiler with the solvent drawn from the sump of the separator distillation column by an indirect heat exchange process and feeding back the reflux so heated to plates of the separator distillation column under the entry plate of the separator distillation column. A liquid phase forming on the plates under the entry plate is conducted through the second auxiliary boiler used for cooling the sump product from the extractive distillation column and is partially vaporized to form a vapor-liquid mixture; and e) feeding the vapor-liquid mixture resulting from the partial vaporization in step d) into a lower portion of the separator distillation column so that a vapor forms in the upper portion of the separator distillation column, while a liquid is separated from the vapor and forms a reflux in the lower portion of the separator distillation column.

The invention is based on the knowledge that up to now the comparatively large amount of heat required for operating the separator distillation column is due to a comparatively high temperature to the separator distillation column. Because of that, a considerable amount of solvent evaporates on depressurizing the sump product in the upper portion of the separator distillation column so that a comparatively higher reflux is required to obtain a complete solvent-free aromatic distillate for a given plate number. On the other hand the required heat, which is needed for separation of the aromatic hydrocarbon from the solvent in the lower portion of the separator distillation column, is less when the temperature of the process stream flowing to the lower portion of the separator distillation column is higher. By using the method of the invention one takes this state of affairs into account, since the sump product from the extractive distillation column is fed at a comparatively lower temperature into the upper portion of the separator distillation column and the heat liberated on cooling of the supplied sump product is used for heating of the reflux flowing from the upper portion into the lower portion of the separator distillation column.

Whether the cooling of the sump product from the extractive distillation column is successful depends naturally on the composition of the sump product and the operating conditions of the separator distillation column. The inlet temperature for the sump product in the separator distillation column in every case should be between 105° to 120° C. When N-formyl morpholine is used as selective solvent, this temperature should advantageously be between 110° and 115° C.

It is also advantageous when the method includes feeding the liquid separated from the vapor in step e) from the separator distillation column, after passing through the second auxiliary boiler used for cooling the sump product from the extractive distillation column, additionally, at least partially through a fourth auxiliary boiler through which the solvent from the sump of the separator distillation column is also passed.

In a special embodiment of the invention the method also includes feeding the solvent drawn from the sump of the separator distillation column additionally through a fifth auxiliary boiler located at a lower portion of the separator distillation column and cooling the solvent with another side-stream from the sump of the separator distillation column by an indirect heat exchange.

BRIEF DESCRIPTION OF THE DRAWING

The objects, features and advantages of the present invention will now be illustrated in more detail by the following detailed description, reference being made to the accompanying drawing in which:

The sole figure is a flow diagram showing a preferred embodiment of the method according to the invention, while other more or less nonessential steps performed by auxiliary devices, such as pumps, valves and measuring and regulating devices are not shown.

DETAILED DESCRIPTION OF THE PREFERRED EMBODIMENTS

The hydrocarbon starting material, from which the aromatic hydrocarbon is obtained, is fed through feed pipe 1 into the central portion of the extractive distillation column 2 provided with plates. The selective solvent is delivered by the pipe 3 to the top of the extractive distillation column 2. For heating the extractive distillation column 2 the sump circulating boiler 4 is connected to the extractive distillation column sump, in which an indirect heating of the sump product occurs with medium pressure steam, which is fed to the boiler through pipe 5 and drawn from the boiler through pipe 6. The sump product to be heated is fed from the extractive distillation column through the pipe 7 into the sump circulating boiler 4 and is drawn from it via the pipe 8 and returned to the extractive distillation column 2. Also in the vicinity of the lower portion of the extractive distillation column 2 a first auxiliary boiler 9 is arranged, into which the sump product drawn over the pipe 10 from the extractive distillation column 2 is fed. Here the sump product is cooled by indirect heat exchange with a side-stream, which is drawn from the plate 50 in the lower portion of the extractive distillation column 2 through the pipe 11 and, after passing through the first auxiliary boiler 9, is fed back through the pipe 12 at a entry point beneath the plate 50 into the extractive distillation column 2. The correspondingly precooled sump product arrives subsequently via the pipe 13 in a second auxiliary boiler 14, in which an additional cooling by indirect heat exchange with a side-stream drawn from the chimney plate 21 of the separator distillation column 15. After passing through the second auxiliary boiler 14 the temperature of the sump product is inside the above-mentioned separator column inlet temperature range (105° to 120° C.), so that the sump product can be fed into the separator distillation column 15 via the pipe 17 at a comparatively lower temperature. The entry plate 16 for the sump product is formed according to the invention as a chimney plate and located in the upper portion of the separator distillation column 15, approximately 20 plates below the top of the separator distillation column 15. A depressurization of the sump product occurs in the separator distillation column 15 and causes an additional temperature lowering and also causes the partial vaporization or gasification of the sump product fed into it. As a result of the cooling of the sump product according the invention, the solvent fraction in the vapor phase decreases, so that the required reflux amount at the top of the separator distillation column 15 can be decreased with plate number unchanged. This reflux is collected together with a liquid phase of the input sump product on the entry plate 16 and fed through the pipe 18 into a third auxiliary boiler 19. In this third auxiliary boiler 19 the heat required for the vaporization of the reflux is transferred to the side-stream withdrawn through pipe 18 from the hot solvent by indirect heat exchange. Subsequently the heated side-stream is fed back through the pipe 20 into the separator distillation column 15 under the entry plate 16. The collecting liquid phase on the chimney plate 21 located under the entry plate 16 is withdrawn via the pipe 22 from the separator distillation column 15 and conducted through the second auxiliary boiler 14. In this second auxiliary boiler 14 this side-stream withdrawn through pipe 22 is partially evaporated and subsequently fed through the pipe 25 to an entry point below the chimney plate 21 into the lower portion of the separator distillation column 15. According to a special embodiment of the invention a fourth auxiliary boiler 23 can be provided in addition to the second auxiliary boiler 14, which as already described has been heated with the sump product coming from the first auxiliary boiler 9. The fourth auxiliary boiler 23 is heated with the hot solvent drawn from the sump of the separator distillation column 15. The side-stream from the second auxiliary boiler 14 is split into a partial stream that flows directly into the lower portion of the separator distillation column 15 at the above-mentioned entry point via return pipe 25 and another partial stream that flows from pipe 25 through a pipe 26 into the fourth auxiliary boiler 23, where it is heated by solvent from the sump of the separator distillation column after passing through a fifth auxiliary boiler 28, and is returned to the return pipe 25 via a pipe 24.

The side-stream returned through the pipe 25 into the lower portion of the separator distillation column 15 forms a reflux for the vapor rising from the column sump. For column heating the sump circulating boiler 27 and an additional fifth auxiliary boiler 28 are provided. The sump circulating boiler 27 is fed high pressure steam and the third auxiliary boiler 28 is fed hot solvent. High pressure steam is fed to and drawn from the sump circulating boiler 27 via pipes 29 and 30 respectively, while another side-stream is withdrawn from and fed back to the separator distillation column 15 via pipes 31 and 32 respectively. This other side-stream is heated in the sump circulating boiler 27 by the hot steam. Similarly a side-stream is withdrawn from the separator distillation column 15 above its sump through the pipe 33 and fed to the fifth auxiliary boiler 28. This side-stream is returned to the separator distillation column 15 above its sump after being heated by solvent from the separator distillation column sump in the fifth auxiliary boiler 28.

The solvent separated from the aromatic hydrocarbon is withdrawn from the sump of the separator distillation column 15 through the pipe 35, passes through a fifth auxiliary boiler 28 and subsequently through the fourth auxiliary boiler 23 via the pipe 36 to the sump circulation boiler 37 of the top product distillation column 38 for separating a top product from the top of the extractive distillation column 2. From there the solvent flows through the pipe 39 to the third auxiliary boiler 19. After passing through the third auxiliary boiler 19, it flows into the air cooler 41 via the pipe 40. The air cooler 41 provides a minimal cooling of the solvent prior to return to the extractive distillation column 2 through the pipe 3. In the process according to the invention at four different locations heat is transferred to other process streams from the solvent, so that solvent heat content can be utilized in an optimum way to improve process energy economics.

The aromatic hydrocarbon separated from the solvent leaves the top of the separator distillation column 15 through the pipe 42 and is condensed in the cooler 43. Subsequently a partial flow of this aromatic hydrocarbon is delivered from the cooler 43 to the separator distillation column 15 via the pipe 44 to provide a reflux in the upper portion of the separator distillation column 15, while the major portion of the aromatic hydrocarbon is fed as a product over the pipe 45 from the apparatus performing the process according to the invention.

The nonaromatic hydrocarbons leaving the top of the extractive distillation column 2 are fed through the pipe 46 to the top product distillation column 38, in which they are separated by distillation from the solvent residue present. The solvent-free nonaromatic hydrocarbons leave as a top product through the pipe 47 from the top product distillation column 38. At the sump of the top product distillation column 38 the boiler 37 is located, which, as already mentioned, heats by indirect heat exchange with the hot solvent fed through the pipe 36. The boiler 37 is connected with the top product distillation column 38 by the pipe 48 for feed and by the pipe 49 for withdrawal. The solvent rich product flow drawn from the sump of this column can be fed back either directly to the extractive distillation column 2 or it is fed into the solvent circulation in the pipe 39. Both possibilities are not shown in the drawing.

Using the method of the invention a considerable energy saving is obtained using the described heat exchange processes. Thus with an aromatic hydrocarbons plant with a throughput capacity of 14.5 t/h, a saving of heating rate (high pressure steam) in the sump circulating boiler 27 of the separator distillation column of 1128 Gcal/h, which corresponds to a saving of about 65%, occurs. Of course, a portion of this energy saving is cancelled out, because in using the method of the invention in operation of the sump circulating boiler 4 of the extractive distillation column there is a somewhat higher requirement for medium pressure steam, since the hot solvent drawn from the sump of the separator distillation column is not conducted through the auxiliary boilers of the extractive distillation column in this case, but through the auxiliary boiler 28, 23 and 19 located on the separator distillation column. Inspite of that with the method according to the invention a net saving of about 21% occurs. Since this reduction in energy requirement also results in a reduction in cooling water requirements, the use of the method of the invention is a considerable improvement in the overall process efficiency.

While the invention has been illustrated and described as embodied in a method of obtaining a pure aromatic hydrocarbon from a sump product of an extractive distillation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Method of obtaining a pure aromatic hydrocarbon from a sump product of an extractive distillation of a hydrocarbon starting mixture, said method comprising the steps of:

a) extractively distilling a hydrocarbon starting mixture containing an aromatic hydrocarbon to be obtained in pure form with a selective solvent in an extractive distillation column having a sump and plates, a sump product being drawn from the sump of the extractive distillation column;

b) feeding the sump product from the extractive distillation column through a first auxiliary boiler and subsequently through a second auxiliary boiler, said first and second auxiliary boilers being connected with each other in series, to form a cooled sum product at a temperature from 105° to 120° C. by indirect heat exchange with other process streams formed in said method and fed through said first and second auxiliary boilers;

c) feeding a side-stream withdrawn from one of the plates of the extractive distillation column in a lower portion of the extractive distillation column through the first auxiliary boiler to cool the sump product and subsequently returning said side-stream, after passage through the first auxiliary boiler, to the extractive distillation column, said side-stream from the extractive distillation column being one of said other process streams;

d) delivering the cooled sump product at temperatures from 105° to 120° C. into an upper portion of a separator distillation column having a top, a sump, and plates including an entry plate, said entry plate being formed as a chimney plate, said cooled sump product being delivered at the entry plate;

e) collecting a reflux from the upper portion of the separator distillation column on the entry plate to form a collected reflux and feeding the collected reflux into a third auxiliary boiler;

f) heating the collected reflux in the third auxiliary boiler in an indirect heating process with solvent drawn from the sump of the separator distillation column and passed through the third auxiliary boiler to form a heated reflux;

g) returning the heated reflux to the separator distillation column at another plate under the entry plate to form a liquid phase on said other plate;

h) conducting the liquid phase collected on the other plate through the second auxiliary boiler to cool the sump product from the extractive distillation column and to form a vapor-liquid mixture by partial vaporization caused by transfer of heat from the sump product to the liquid phase, said liquid phase conducted to the second auxiliary boiler being another of said other process streams;

i) feeding said vapor-liquid mixture from step h) into a lower portion of the separator distillation column to form a vapor in the upper portion of the separator distillation column and a reflux in the lower portion of the separator distillation column; and j) distilling the cooled sump product from the extractive distillation column in the separator distillation column, the aromatic hydrocarbon leaving the top of the separator distillation column in a pure form.

2. Method as defined in claim 1, wherein the temperatures of the cooled sump product delivered to the separator distillation column are from 110° to 115° C.

3. Method as defined in claim 1, further comprising feeding at least a portion of the liquid-vapor mixture from the second auxiliary boiler through a fourth auxiliary boiler for further vaporization, said portion of said liquid-vapor mixture passing through said fourth auxiliary boiler being heated by said solvent drawn from the sump of the separator distillation column prior to passage through said third auxiliary boiler.

4. Method as defined in claim 3, further comprising drawing a side-stream from the lower portion of the separator distillation column above the sump and passing the side-stream so formed and also said solvent drawn from the sump of the separator distillation column through a fifth auxiliary boiler so that said solvent drawn from the separator distillation column and passed through the fifth auxiliary boiler is at least in part cooled by the side-stream drawn from the lower portion of the separator distillation column and said side stream from the lower portion is heated thereby in an indirect heat exchange.

5. Process as defined in claim 4, further comprising returning the side-stream drawn from the lower portion of the separator distillation column after passage through the fifth auxiliary boiler to the lower portion of the separator distillation column.

6. Process as defined in claim 4, wherein said solvent drawn from the sump of the separator distillation column is fed to the fourth auxiliary boiler after passage through the fifth auxiliary boiler.

7. Process as defined in claim 1, wherein the selective solvent is an N-substituted morpholine.

8. Process as defined in claim 1, wherein the selective solvent is N-formyl morpholine.

9. Process as defined in claim 1, further comprising withdrawing another side-stream from the separator distillation column and passing said other side-stream through a sump circulating boiler heated by high pressure steam to supply heat to said separator distillation column.

* * * * *